US007447326B2

(12) United States Patent
Akino

(10) Patent No.: US 7,447,326 B2
(45) Date of Patent: Nov. 4, 2008

(54) CONDENSER MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 405 days.

(21) Appl. No.: 11/118,388

(22) Filed: May 2, 2005

(65) Prior Publication Data

US 2005/0254679 A1 Nov. 17, 2005

(30) Foreign Application Priority Data

May 11, 2004 (JP) ..... 2004-140594

(51) Int. Cl.
*H04R 11/04* (2006.01)
*H04R 19/04* (2006.01)

(52) U.S. Cl. ..... 381/363; 381/189

(58) Field of Classification Search ..... 381/189, 381/363, 174, 355, 356, 361, 362, 366; 439/395, 439/775, 825

See application file for complete search history.

(56) References Cited

U.S. PATENT DOCUMENTS 2,579,162 A * 12/1951 Veneklasen ..... 381/174
3,736,632 A * 6/1973 Barrow ..... 381/173
4,880,570 A * 11/1989 Sanborn et al. ..... 252/512
5,645,445 A * 7/1997 Siemon et al. ..... 439/395
2004/0005070 A1 * 1/2004 Kanda et al. ..... 381/369

* cited by examiner

*Primary Examiner*—Suhan Ni
*Assistant Examiner*—Jesse A Elbin
(74) *Attorney, Agent, or Firm*—Manabu Kanesaka

(57) ABSTRACT

In a gooseneck condenser microphone, the generation of noise caused by strong electromagnetic waves sent from a cellular phone etc. is prevented by adding a simple element. In a gooseneck condenser microphone comprising a microphone capsule 10 which includes a condenser microphone unit and generates an audio signal via an impedance converter; a flexible support pipe 20 which supports the microphone capsule 10 on the upper end side thereof; and a microphone cord (a two-core shielded cable) 30 one end of which is connected to the impedance converter and the other end of which is pulled out of a base end portion 21 of the support pipe 20 after passing through the support pipe 20 and is connected to an output circuit section 40, an upper end of the support pipe 20 being connected electrically to a shield covered line included in the microphone cord 30 on one end side of the microphone cord 30, the base end portion 21 of the support pipe 20 is further connected electrically to a part of the shield covered line of the microphone cord 30.

2 Claims, 3 Drawing Sheets

CONDENSER MICROPHONE

RELATED APPLICATIONS the present application is based on, and claims priority from, Japanese Application Number 2004-140594, filed May 11, 2004, the disclosure of which is hereby incorperated by reference herein in it entirety.

TECHNICAL FIELD

The present invention relates to a gooseneck condenser microphone in which a microphone capsule is supported by a metallic support pipe including a flexible shaft. More particularly, it relates to a technique for preventing the generation of noise caused by strong electromagnetic waves sent from a cellular phone etc.

BACKGROUND ART

Microphones are properly used depending on purposes such as music, studio, conference, and video camera. Among these, for conference, a gooseneck condenser microphone is used in many cases because the direction of microphone can be changed freely and the microphone is not so conspicuous.

A typical conventional example is explained with reference to FIGS. 4 to 6. First, as shown in a general configuration view of FIG. 4, for a gooseneck condenser microphone, a microphone capsule 10 is used by being installed, for example, on a table, not shown, via a support pipe 20.

In this example, the support pipe 20 is provided with a base end portion 21 threadedly attached to a fixing member, not shown, on the table top side, a first flexible shaft 22, a telescopic intermediate pipe 23 whose length is adjustable, and a second flexible shaft 24 in that order from the lower side. At the upper end of the second flexible shaft 24, a capsule support section 25 is provided. All of these members are made of a metal. Since the flexible shafts 22 and 24 are flexible, the microphone capsule 10 can be directed to a suitable position with respect to a sound source (speaker).

Referring to FIG. 5, the microphone capsule 10 is provided with a cylindrical housing 11 made of, for example, aluminum, and although not shown, the housing 11 contains a condenser microphone unit in which a diaphragm stretchedly provided on a support ring and a backplate consisting of, for example, an electret board supported on an insulating seat are arranged opposedly via an electrical insulating spacer.

The back surface side of the housing 11 is closed by a back lid 12, and a contact pin 13 connected to the backplate protrudes from the back lid 12. Also, on the back surface side of the housing 11, a connection thread 14 having a internal thread 141 on the inside surface, which is for connection with the capsule support section 25, is fixed to the housing 11 so as to provide electrical conduction.

The capsule support section 25 is provided with a cylindrical housing 251 made of a brass material, for example, and in the housing 252, a circuit board 252 is arranged so as to close the interior of the housing 251. On the circuit board 252, an impedance converter (FET: Field Effect Transistor) 253 is mounted. On the lower surface side of the circuit board 252, one end of a microphone cord 30, which is pulled out by being inserted through the support pipe 20, is soldered.

To a gate terminal of the impedance converter 253, one side of a contact terminal 254 is connected by soldering, the contact terminal 254 consisting of a plate spring bent substantially into a V shape so as to be in elastic contact with the contact pin 13. The circuit board 252 is fixed in the housing 251 by a fixing ring 255.

Specifically, the fixing ring 255 has an external thread 255*a* on the outer peripheral surface thereof, and on the other hand, in the housing 251, a step portion 251*a* for receiving the circuit board 252 and an internal thread 251*b* threadedly engaged with the external thread 255*a* are provided. By threadedly engaging the fixing ring 255 with the internal thread 251*b*, the circuit board 252 is fixed so as to be urged against the step portion 251*a*. The screwing amount of the fixing ring 255 is about a lower half of the internal thread 251*b*, and an upper half thereof is left for connecting the microphone capsule 10.

The microphone capsule 10 and the capsule support section 25 are connected mechanically by threadedly engaging the internal thread 141 of the connection thread 14 with the upper half side of the external thread 255*a*. Accordingly, the contact pin 13 comes into elastic contact with the contact terminal 254, by which the microphone capsule 10 and the capsule support section 25 are also connected electrically.

As the microphone cord 30, a two-core shielded cable is used which includes a power line for supplying power to the condenser microphone unit in the microphone capsule 10, a signal line for sending an audio signal generated by the impedance converter (FET) to an output circuit section 40, described later, and a shield covered line for electrostatically shielding and grounding the power line and signal line.

FIG. 6 shows the lower surface side of the circuit board 252. At the periphery on the lower surface side of the circuit board 252, a gland pattern 252*a* is formed in a ring shape, and also at the periphery on the upper surface side of the circuit board 252, a gland pattern 252*b* is formed in a ring shape similarly. These gland patterns 252*a* and 252*b* are brought into conduction each other by plating in a through hole. Although not shown in FIG. 6, besides, the circuit board 252 is formed with electrode patterns of the gate, drain, and source of FET.

The shield covered line included in the microphone cord 30 is connected by soldering to the circuit board 252 so as to connect with the gland pattern 252*a* on the lower surface side. Also, the housing 11 of the microphone capsule 10 is electrically connected to the gland pattern 252*b* on the upper surface side via the connection thread 14 and the fixing ring 255, and the housing 251 of the capsule support section 25 is electrically connected to the gland pattern 252*a* on the lower surface side in a portion of the step portion 251*a*.

Referring again to FIG. 1, the other end of the microphone cord 30 is pulled out of the base end portion 21 side of the support pipe 20, and is connected to the output circuit section (power module section) 40. The output circuit section 40 has a shield case 41. Although not shown, the shield case 41 contains an audio output circuit board including a low cut filter circuit and a transformer, a three-pin type output connector specified in EIAJ RC5236, and the like, and the output connector is connected with a phantom power source via a balanced shielded cable, not shown.

The microphone cord 30 consisting of the two-core shielded cable is vulnerable to (liable to be affected by) noise from the outside because the audio signal is transmitted imbalancedly. Therefore, if strong electromagnetic waves are applied to the microphone cord 30, the electromagnetic waves intrude into the condenser microphone unit in the microphone capsule 10 and the output circuit section 40, by which noise is sometimes generated.

In particular, in the gooseneck microphone constructed as described above, the housing 11 of the microphone capsule 10 and the support pipe 20 are commonly grounded in portions of the gland patterns 252*a* and 252*b* of the circuit board 252 arranged on the upper end side of the support pipe 20, so that the support pipe 20 sometimes acts as an antenna if it receives strong electromagnetic waves.

As a result, the electromagnetic waves received by the support pipe 20 intrude from the gland pattern to the grounding side of the impedance converter (FET) 253, and the impedance converter detects the waves, by which noise is generated.

In recent years, cellular phones have come into wide use. In the case where a cellular phone is used in the immediate vicinity of a microphone, the microphone receives considerably strong electromagnetic waves (for example, in the range of several centimeters to several tens centimeters, field intensity reaching several ten thousands of intensity of field generated in the city by commercial electric waves), so that measures against cellular phones are a pressing need in the field of microphone.

As one method for answering the need, a technique in which, for example, in a gun microphone in which the microphone unit is housed in a housing cylinder consisting of a conductor, the microphone unit is connected (grounded) to the housing cylinder consisting of a conductor at the shortest distance has been proposed in Patent Document 1 (Japanese Patent Application Publication No. 2001-103591).

However, although being effective for the gun microphone or the like, this method cannot be applied to a microphone in which, as in the conventional example, the microphone capsule and the audio output section are separated from each other and are connected to each other via the microphone cord.

SUMMARY OF THE INVENTION

Accordingly, a problem to be solved by the present invention is to add a simple element to thereby effectively prevent the generation of noise caused by strong electromagnetic waves sent from a cellular phone etc. in a gooseneck microphone in which a microphone capsule is supported by a metallic support pipe including a flexible shaft.

To solve the above problem, the present invention provides a gooseneck condenser microphone comprising a microphone capsule which includes a condenser microphone unit and generates an audio signal via an impedance converter; a metallic support pipe which includes a flexible shaft and supports the microphone capsule on the upper end side thereof; and a microphone cord consisting of a two-core shielded cable one end of which is connected to the impedance converter and the other end of which is pulled out of a base end portion of the support pipe after passing through the support pipe and is connected to an output circuit section, a housing of the microphone capsule and an upper end of the support pipe being connected electrically to a shield covered line included in the microphone cord on one end side of the microphone cord, wherein the base end portion of the support pipe is further connected electrically to a part of the shield covered line of the microphone cord pulled out of the base end portion.

In the present invention, if the base end portion of the support pipe and the shield covered line of the microphone cord are connected to each other by any method, the above problem is solved. However, from the realistic viewpoint of productivity, it is preferable that an exposed portion of shield covered line formed by peeling off a sheath be provided at a part of the microphone cord pulled out of the base end portion of the support pipe, and the exposed portion of the shield covered line and the inner surface of base end portion of the support pipe be connected electrically to each other via conduction means.

As preferable modes of the conduction means, a mode in which the conduction means is fitted to the exposed portion of the shield covered line, and consists of a metallic tube of a C shape in cross section, which is in elastic contact with the inner surface of base end portion of the support pipe, and a mode in which the conduction means consists of a conductive bonding material packed between the exposed portion of the shield covered line and the inner surface of base end portion of the support pipe are embraced.

According to the present invention, the support pipe is electrically connected to the shield covered line of the microphone cord at two locations of the upper end side of the support pipe and the base end portion side thereof. Therefore, even if strong electromagnetic waves are applied to the support pipe, the electromagnetic waves do not concentrate on the impedance converter side, so that the generation of noise is restrained. Also, the support pipe itself acts as a shield (double shield) for the microphone cord, so that the generation of noise is restrained more effectively.

DETAILED DESCRIPTION

Figure 1:
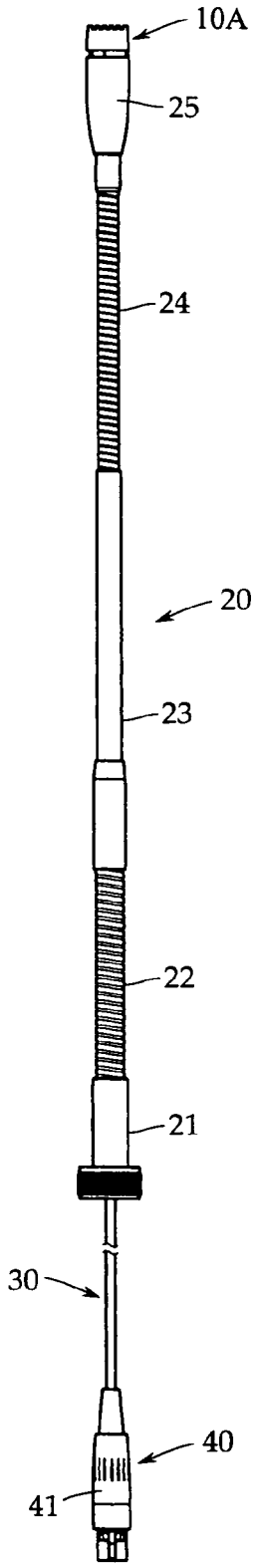
FIG. 1 is a front view showing a general configuration of a gooseneck microphone in accordance with the present invention.
Figure 2:
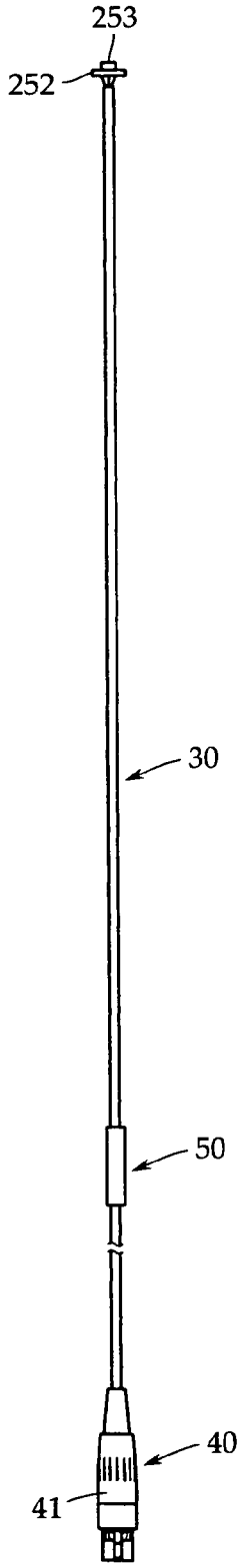
FIG. 2 is a front view showing a state in which a microphone cord and parts connected thereto are pulled out of a support pipe of the condenser microphone shown in FIG. 1.
Figure 3:
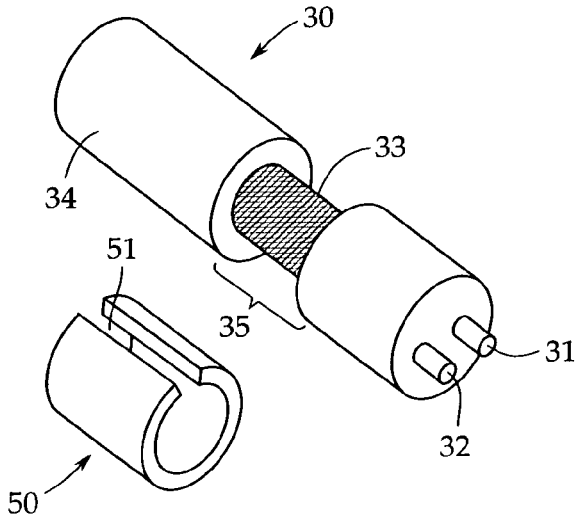
FIG. 3 is a perspective view enlargedly showing an essential portion of the present invention.
Figure 4:
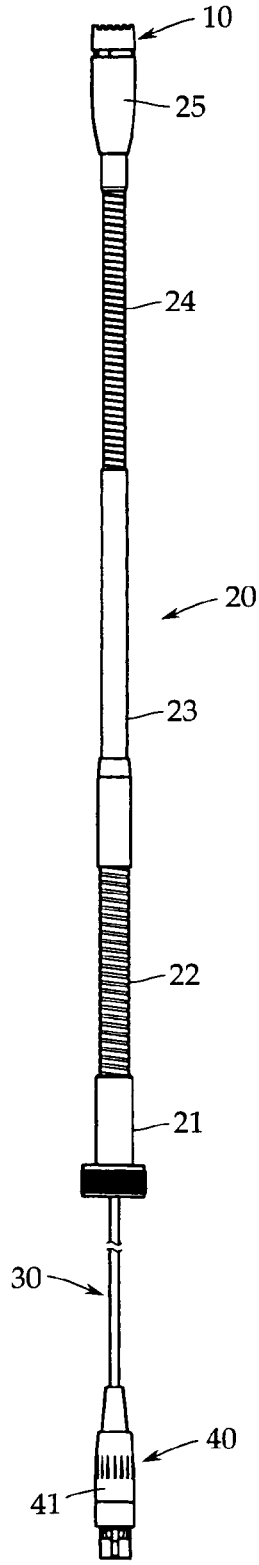
PRIOR ART FIG. 4
FIG. 4 is a front view showing a conventional example of a gooseneck microphone, being similar to FIG. 1.
Figure 5:
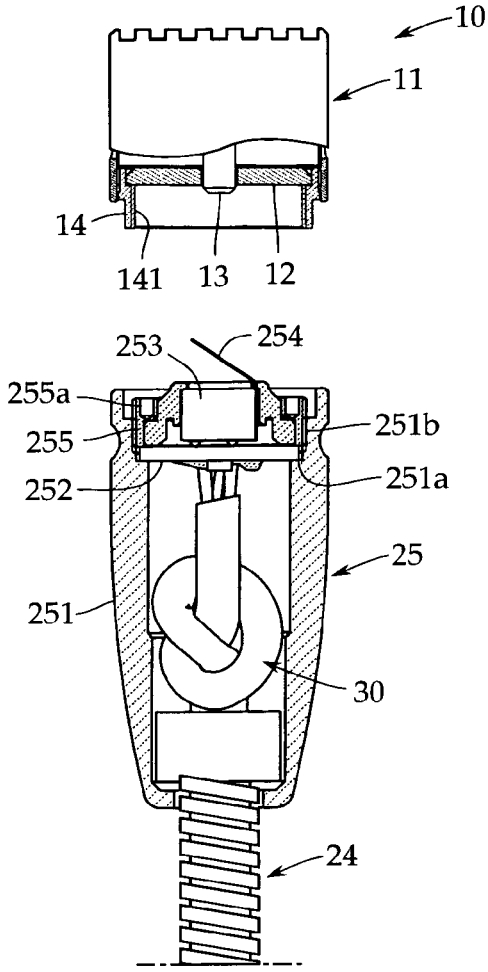
PRIOR ART FIG. 5
FIG. 5 is a sectional view showing a microphone capsule and a capsule support section, which are separated from each other, included in the conventional example shown in FIG. 4.

An embodiment of the present invention will now be described with reference to FIGS. 1 to 3. The present invention is not limited to this embodiment. FIG. 1 is a front view showing a general configuration of a gooseneck microphone in accordance with the present invention, being the same as the aforementioned FIG. 4. FIG. 2 is a front view showing a state in which a microphone cord and parts connected thereto are pulled out of a support pipe, and FIG. 3 is a perspective view enlargedly showing an essential portion of the present invention. In these figures, the same reference numerals are applied to elements that are the same or regarded as the same as the elements in the conventional example explained before. Also, for the construction of a microphone capsule and a capsule support section, refer to FIG. 5.

Since the condenser microphone in accordance with the present invention is of a gooseneck type, as shown in FIG. 1, a microphone capsule 10A is attached to the upper end of a flexible support pipe 20, and is used by being installed on a table, not shown, etc. via the support pipe 20.

The microphone capsule 10A includes a condenser microphone unit, not shown, and may have the same construction as explained before. In the present invention, however, unlike the conventional example, the microphone capsule 10A need not be detachable from (replaceable) a capsule support section 25 of the support pipe 20, and may be integral with the capsule support portion 25.

Figure 6:
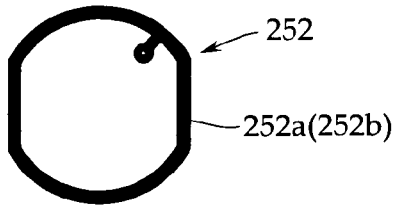
PRIOR ART FIG. 6
FIG. 6 is a schematic lower surface view of a circuit board arranged in the capsule support section of the conventional example shown in FIG. 6.

Also, an impedance converter 253 may be housed in the microphone capsule 10A. However, in the present invention as well, like the conventional example, a housing 11 of the microphone capsule 10A and the support pipe 20 are commonly grounded in portions of gland patterns 252*a* and 252*b* (refer to FIG. 6) of a circuit board 252 arranged on the upper end side of the support pipe 20.

For the support pipe 20 as well, a base end portion 21 is necessary for attaching the support pipe 20 to a fixing member on the table top side, and, for example, the whole of a portion between the base end portion 21 and the capsule support section 25 may be formed by a flexible shaft. Also, in some cases, the base end portion 21 may be fixed directly on the table top without using the fixing member.

A microphone cord 30 is inserted through the support pipe 20, and one end side thereof is connected by soldering to the circuit board 252 in the capsule support section 25. The other end of the microphone cord 30 is pulled out of the base end portion 21 and connected to an output circuit section 40. The output circuit section 40 may have the same construction as that of the conventional example; however, in the present invention, the power source is not limited to a phantom power source.

As the microphone cord 30, a two-core shielded cable is used as in the conventional example explained before. Specifically, as shown in FIG. 3, the microphone cord 30 consists of a two-core shielded cable including a power line 31 for supplying power to the condenser microphone unit in the microphone capsule 10A, a signal line 32 for sending an audio signal generated by the impedance converter 253 to the output circuit section 40, and a shield covered line 33 for electrostatically shielding and grounding the power line 31 and signal line 32.

Of these lines, the shield covered line 33 is connected to the gland pattern 252*a* of the circuit board 252 on one end side of the microphone cord 30. Specifically, one end of the shield covered line 33 is connected to the upper end of the support pipe 20 via the gland pattern 252*a*. According to the present invention, the shield covered line 33 is also connected electrically to the base end portion 21 of the support pipe 20.

Therefore, in this example, as shown in FIG. 2, a metallic tube 50 serving as conduction means is attached to a portion corresponding to the base end portion 21 of the microphone cord 30. FIG. 3 shows one example of a state in which the metallic tube 50 is attached to the microphone cord 30.

According to FIG. 3, the microphone cord 30 is provided with an exposed portion 35 of the shield covered line 33, which is formed by partially peeling off a sheath 34, and the metallic tube 50 is attached to the exposed portion 35 of the shield covered line 33 so as to be in electric contact with the shield covered line 33. It is preferable that the metallic tube 50 consist of a metallic tube of a C shape in cross section, which is formed with a slit 51 cut in the axial direction, and be formed of a plate spring material such as a copper alloy.

The metallic tube 50 is fitted to the exposed portion 35 of the shield covered line 33 by expanding the slit 51, and is formed so that the outside diameter thereof is larger than the inside diameter of the base end portion 21. Therefore, when the microphone cord 30 is inserted in the support pipe 20, the metallic tube 50 is caused to fit forcedly in the base end portion 21, by which the metallic tube 50 is elastically brought into contact with the inner surface of the base end portion 21.

In this manner, the support pipe 20 is electrically connected to the shield covered line 33 included in the microphone cord 30 at two locations of the capsule support section 25 on the upper end side of the support pipe 20 and the base end portion 21 on the lower end side thereof. Therefore, for example, even if a cellular phone is used in the immediate vicinity of the microphone and hence strong electromagnetic waves are applied to the support pipe 20, the electromagnetic waves do not concentrate at the common grounding location on the capsule support section 25.

Therefore, even if electromagnetic waves are detected by the impedance converter 253, the detection amount is slight, so that the generation of noise is restrained as compared with the conventional example. Also, the support pipe 20 itself acts as a shield pipe for the microphone cord 30, so that the generation of noise is restrained more effectively.

In order for the electrical connection between the shield covered line 33 and the base end portion 21 via the metallic tube 50 to provide low impedance even for high-frequency waves, the inner and outer surfaces of the metallic tube 50 are preferably coated with a conductive bonding (adhesive) material.

Also, as another example, a mode in which the metallic tube 50 is not used, and the exposed portion 35 of the shield covered line 33 is filled with the conductive bonding (adhesive) material, by which the shield covered line 33 and the base end portion 21 are connected electrically to each other by only the conductive bonding material is also embraced in the present invention.

The invention claimed is:

1. A gooseneck condenser microphone comprising:

a microphone capsule which includes a condenser microphone unit and generates an audio signal via an impedance converter, said microphone capsule having a metal housing;

a metallic support pipe which includes a flexible shaft with an upper end and a base end, and is connected to the metal housing to support the microphone capsule on the upper end thereof; and a microphone cord consisting of two cores and a shield line entirely covering the two cores with a sheath covering the shield line, one end of which is connected to the impedance converter and the other end of which is pulled out of the base end of the support pipe after passing through the support pipe and is connected to an output circuit section, wherein the housing of the microphone capsule and the upper end of the support pipe are connected electrically to the shield line of the microphone cord, and the base end of the support pipe is further connected electrically to a part of the shield line of the microphone cord so that the metallic support acts as a shield for the microphone cord, and wherein the sheath of the microphone cord is peeled off at the base end of the support pipe to form an exposed portion, and said exposed portion and an inner surface of base end of the support pipe are connected electrically to each other through a metallic tube with a C-shape in cross section as conduction means, fitted to the exposed portion of the shield line, said metallic tube being in elastic contact with the inner surface of base end portion of the support pipe.

2. The condenser microphone according to claim 1, wherein said metallic support pipe includes first and second bendable shafts and a telescopic intermediate pipe interposed therebetween.

* * * * *